US008063576B2

(12) United States Patent
Routledge

(10) Patent No.: US 8,063,576 B2
(45) Date of Patent: Nov. 22, 2011

(54) LIGHT EMITTING DIODE (LED) CONTROL

(75) Inventor: Gordon Routledge, North Yorkshire (GB)

(73) Assignee: Dialight Lumidrives Limited, Cambridgeshire (GB)

( * ) Notice: Subject to any disclaimer, the term of this patent is extended or adjusted under 35 U.S.C. 154(b) by 367 days.

(21) Appl. No.: 11/575,393

(22) PCT Filed: Sep. 13, 2005

(86) PCT No.: PCT/GB2005/003519

§ 371 (c)(1),
(2), (4) Date: Sep. 22, 2008

(87) PCT Pub. No.: WO2006/030191

PCT Pub. Date: Mar. 23, 2006

(65) Prior Publication Data

US 2009/0009092 A1 Jan. 8, 2009

(30) Foreign Application Priority Data

Sep. 17, 2004 (GB) ..... 0420632.2

(51) Int. Cl.
*H05B 37/02* (2006.01)

(52) U.S. Cl. ..... 315/291; 315/169.3; 315/307

(58) Field of Classification Search ..... 315/291, 315/307, 308, 169.3; 362/227, 228, 231
See application file for complete search history.

(56) References Cited

U.S. PATENT DOCUMENTS

| | | | | |
|---|---|---|---|---|
| 6,473,065 | B1 | 10/2002 | Fan | |
| 7,161,556 | B2 * | 1/2007 | Morgan et al. | 345/1.1 |
| 2004/0105261 | A1 | 6/2004 | Ducharme et al. | |
| 2004/0135524 | A1 | 7/2004 | Gunter et al. | |
| 2006/0220571 | A1 * | 10/2006 | Howell et al. | 315/86 |

OTHER PUBLICATIONS

International Preliminary Report on Patentability and Written Opinion of the International Searching Authority, mailed Mar. 29, 2007, for corresponding International Application No. PCT/GB2005/003519.

* cited by examiner

*Primary Examiner* — David Hung Vu
(74) *Attorney, Agent, or Firm* — Klarquist Sparkman, LLP

(57) ABSTRACT

Apparatus and a method are disclosed for providing illumination from at least one light emitting diode lighting fixture. Each lighting fixture includes a respective LED array and the method includes the steps of determining at least one parameter associated with the LED array and supplying drive signals to light LEDs in the LED array responsive to the parameter thereby providing illumination having a desired characteristic from said lighting fixture.

18 Claims, 4 Drawing Sheets

LIGHT EMITTING DIODE (LED) CONTROL

CROSS REFERENCE TO RELATED APPLICATIONS

This is the U.S. National Stage of International Application No. PCT/GB2005/003519, filed Sep. 13, 2005, which was published in English under PCT Article 21(2), which in turn claims the benefit of Great Britain Patent Application No. 0420632.2, filed Sep. 17, 2004.

The present invention relates to a method and apparatus for providing illumination from one or more light emitting diode (LED) lighting fixtures. In particular, but not exclusively, the present invention provides a method and apparatus which can ensure that a desired observed colour can be provided and maintained by many such lighting fixtures arranged in a lighting system.

Light emitting diodes (LEDs) are rapidly becoming a major source of light for a variety of applications. Not only can LED lighting fixtures provide illumination by which users can see to carry out activities but also they can provide illumination of a desired colour and intensity for aesthetic purposes. It is expected that by the year 2014 one in four light sources will be an LED.

Lighting fixtures are well known in the art. They include an LED array often including LEDs of different colours arranged in an addressable matrix. The LEDs are typically mounted on a circuit board (PCB) and are supported by a lighting fixture body which is often formed from stainless steel or other rigid material. The LEDs in the LED array are individually addressable with drive signals so that each LED may be turned on or off as desired. Drive signals are produced to drive these LEDs via power driver circuitry. Such circuitry may be in the lighting fixture itself or may comprise a discrete piece of hardware. It is envisaged that lighting fixtures having a desired specification may be purchased by an ultimate user or designer wishing to create a lighting system. The lighting fixtures may then be located at desired locations in a room or around a space and the illumination created by those lighting fixtures may be controlled by a power controller which provides signals to the power driver circuitry of each LED array. The DMX standard is a signalling standard which is often used to produce the signals to the power control circuitry which generate drive signals to light up the LEDs in response. It is to be understood that the present invention is not restricted to applications which use DM signalling.

When LEDs are produced they may vary from one another in terms of a number of parameters. These variations are often due to the manufacturing processes used to create the LEDs. Notably the wavelength of colour emitted in nanometers (nm) for coloured LEDs and (correlated) colour temperature for degrees Kelvin (for white LEDs) may vary. A further parameter which may vary is intensity which is to say that each LED output can vary from a minimum to a maximum value usually measured in Candela or Lumens. To try to overcome this problem when LEDs are produced they are allocated a BIN code which defines to a lighting manufacturer the above parameters. For example red LEDs are allocated one of three possible BIN numbers. Effectively the BIN code indicates what colour and intensity may be expected when that particular LED is driven by suitable drive signals to light the LED. As another example, a blue colour LED may comprise five BINs for intensity and five BINs for colour band width.

It is also known that an LEDs output and colour bandwidth may vary with junction temperature which is a function of the power supplied to an LED and its thermal environment. Red and amber LEDs made from AlInGAP materials typically vary exponentially with temperature. By contrast blue, green and white LEDs typically vary in a linear manner with temperature.

This variation with temperature may cause problems when designing an illumination system which is a combination of many lighting fixtures each of which may themselves contain many LEDs. The problem is especially apparent with lighting systems which mix a combination of illumination from red, green and blue LEDs to produce an overall colour which is observed by a user. It will be understood that when LEDs in a lighting fixture are illuminated together the colours emitted from the various colours of LEDs mix to produce such an overall perceived colour. Each of the LEDs in an array of LEDs may be switched on for longer or more intensely to select this overall perceived colour from a gamut of possible colours defined by the properties of all of the LEDs in the LED array, that is wavelengths and intensities of each LED in an array of LEDs.

Usually a large scale illumination system will consist of a number of lighting fixtures with each including an LED array of red, green and blue LEDs controlled by a respective channel which is individually addressable from a central control system such as a mixing desk or lighting control system. The colour output from each lighting fixture is usually selected by sending a numeric value 0 to 255 (or analogue signal 1-10 volts) through the three channels, red, green and blue to each lighting fixture. The signals on each channel are used to determine whether respective LEDs are energised.

A problem occurs when two adjacent lighting fixtures each including a respective LED array are set to the same numeric values. In such a case the actual RGB mixed colour produced from the lighting fixture can vary due to the fixtures being constructed with LEDs from different BIN codes, for example one fixture may have green LEDs from a BIN labelled N1 and an adjacent lighting fixture may have green LEDs from a BIN labelled Q5. Hence the first fixture may be able to create a deep green colour for a fixed numeric value but the further fixture will not be able to create such a colour despite being set to the same value. As a result an observed colour produced by the mixing of outputs from both fixtures may not satisfy a desired specification.

A similar scenario can occur with temperature fluctuations. If an RGB mixed output is set when the fixtures are cool the red content will be a higher percentage at that point than when the fixtures warm up due to the exponential decay of output with respect to temperature. As a result the perceived colour produced by the lighting fixture will change from a desired colour and intensity.

It is an aim of embodiments of the present invention to at least partly mitigate the above-mentioned problems.

It is an aim of embodiments of the present invention to provide a method an apparatus which can maintain an observed colour of illumination from one or more lighting fixtures regardless of temperature fluctuations in such lighting fixtures.

It is an aim of embodiments of the present invention to provide a method and apparatus which can ensure that when one or more lighting fixtures each of which has a respective LED array, are illuminated, the observed colour from each lighting fixture can be predetermined regardless of variations in the particular LEDs used in each LED array.

According to one aspect of the present invention there is provided a method for providing illumination from at least one Light Emitting Diode (LED) lighting fixture each of which comprises a respective LED array, comprising the steps of:

determining at least one parameter associated with an LED array; and supplying drive signals to light LEDs in said LED array responsive to said parameter; thereby providing illumination having a desired characteristic from said lighting fixture.

According to a second aspect of the present invention there is provided apparatus for providing illumination from at least one Light Emitting Diode (LED) lighting fixture, comprising:

at least one LED array, each being associated with a respective lighting fixture;

means for determining at least one parameter associated within an LED array; and power driver circuitry for supplying drive signals to selectively light LEDs in the LED array responsive to the determined parameter; wherein the LEDs are lit so as to provide illumination having a desired characteristic.

Embodiments of the present invention provide the advantage that as an array of LEDs heat up or cool down the output colour from the LEDs is maintained at a desired colour or within a desired range of colours. This is achieved by selecting the control signals to one or more LEDs in an LED array in response to temperature measurements at that LED array.

Embodiments of the present invention provide an advantage that it is possible to ensure that each of a plurality of lighting fixtures (each of which may be formed of LEDs having different characteristics) can be made to generate a substantially identical colour and intensity regardless of differences in the LEDs in the particular LED arrays.

Embodiments of the present invention will now be described hereinafter, by way of example only with reference to the accompanying drawings in which.

In the drawings like reference numerals refer to like parts.

Figure 1:
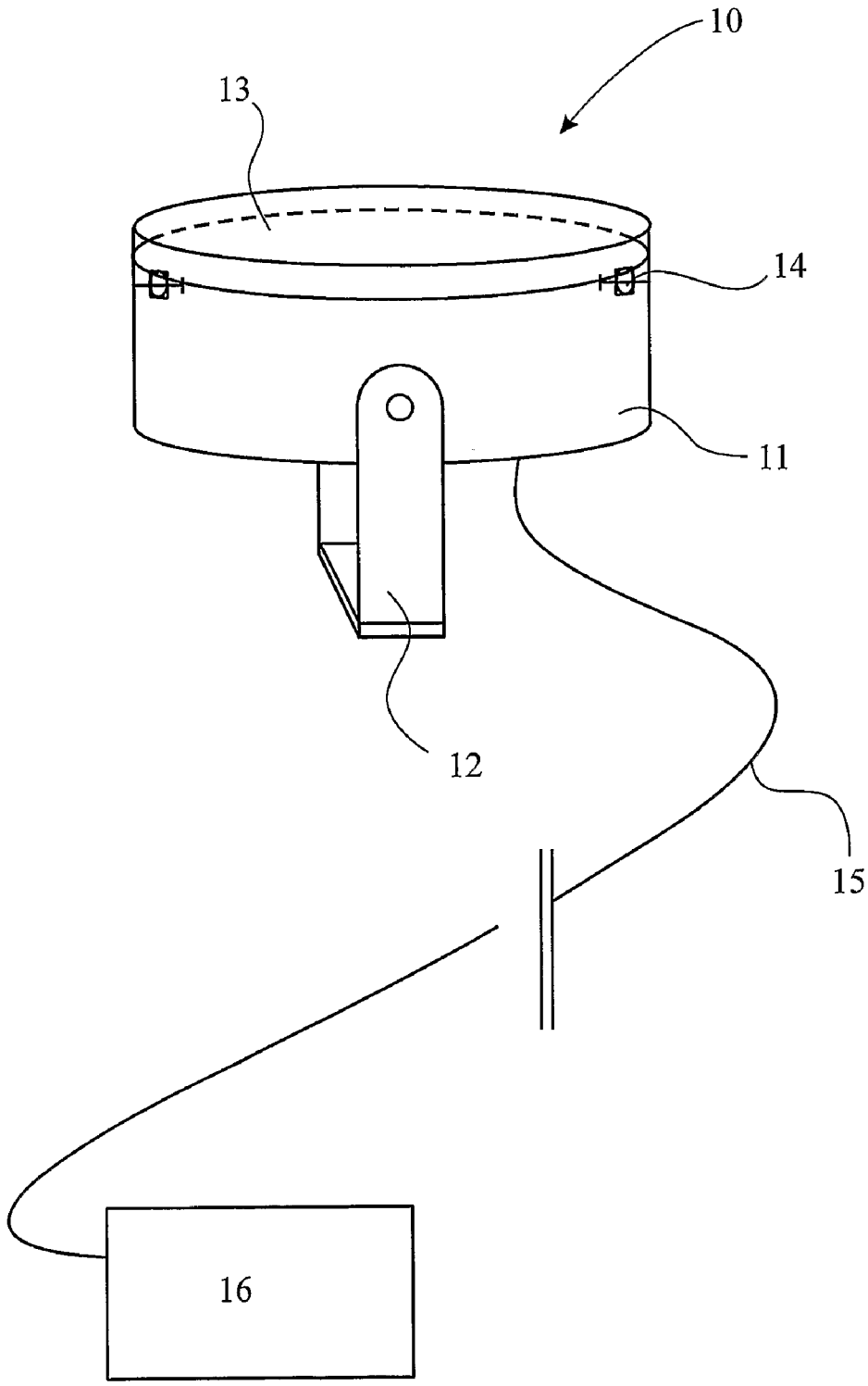
FIG. 1 illustrates a lighting fixture.

FIG. 1 illustrates a lighting Fixture 10 which includes a fixture body 11 which may be formed of some rigid or semi-rigid material such as stainless steel or plastic and which is supported by a pivotable mounting structure 12 so that illumination formed from an LED array mounted on support 13 may be directed at a desired target location in a room or space. The LED array may be secured to the lighting fixture body 11 by a securing mechanism such as releasable screws 14. It will be understood that embodiments of the present invention are not restricted to lighting fixtures having the shape and dimensions nor indeed the support structures as illustrated in FIG. 1.

The array of LEDs is arranged in an addressable matrix of the programmable circuit board 13. The PCB includes connections so that each LED in the LED array may be independently addressed to be turned on or off. When an LED is turned on the LED provides illumination. When one or more LEDs are turned on simultaneously the overall colour and intensity of the illumination is a combination of all of the independent LEDs which are turned on. In this way white light may be created by a combination of illumination from red, green and blue LEDs. Creating variations in colour from these three colours of LED are well known. A colour space which may be provided by the LEDs is shown in more detail in FIG. 3.

In order to selectively turn the LEDs in the LED array on or off control signals must be supplied to the lighting fixture via connection 15 and these are generated by a power control circuit 16. In embodiments of the present invention the power control circuitry may be located so as to form part of the lighting fixture 10.

Figure 2:
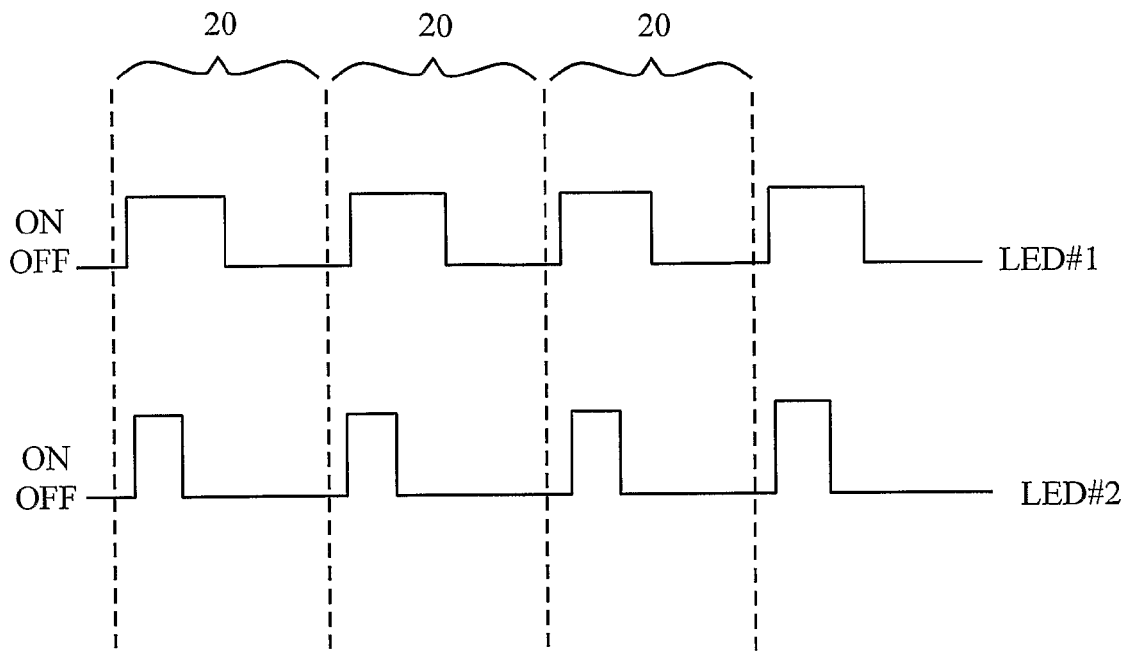
FIG. 2 illustrates drive signals.

Whilst light output of an LED is dependent on the current flowing through it, it is well known that the recommended method of controlling brightness for LEDs is not via current control. Rather a preferred technique for brightness control is through pulse width modulation (PWM). The concept of PWM control of LEDs is illustrated in FIG. 2 in which the on time of a signal supplied to a first LED is greater than an on time signal provided to a second LED. As a result the colour generated per period by both LEDs together will be more greatly influenced by the colour of the first LED. It will of course be understood that embodiments of the present invention are not restricted to use of PWM techniques. Rather other techniques such as frequency width modulation (FWM), bit amplitude control or linear control are also possible.

Figure 3:
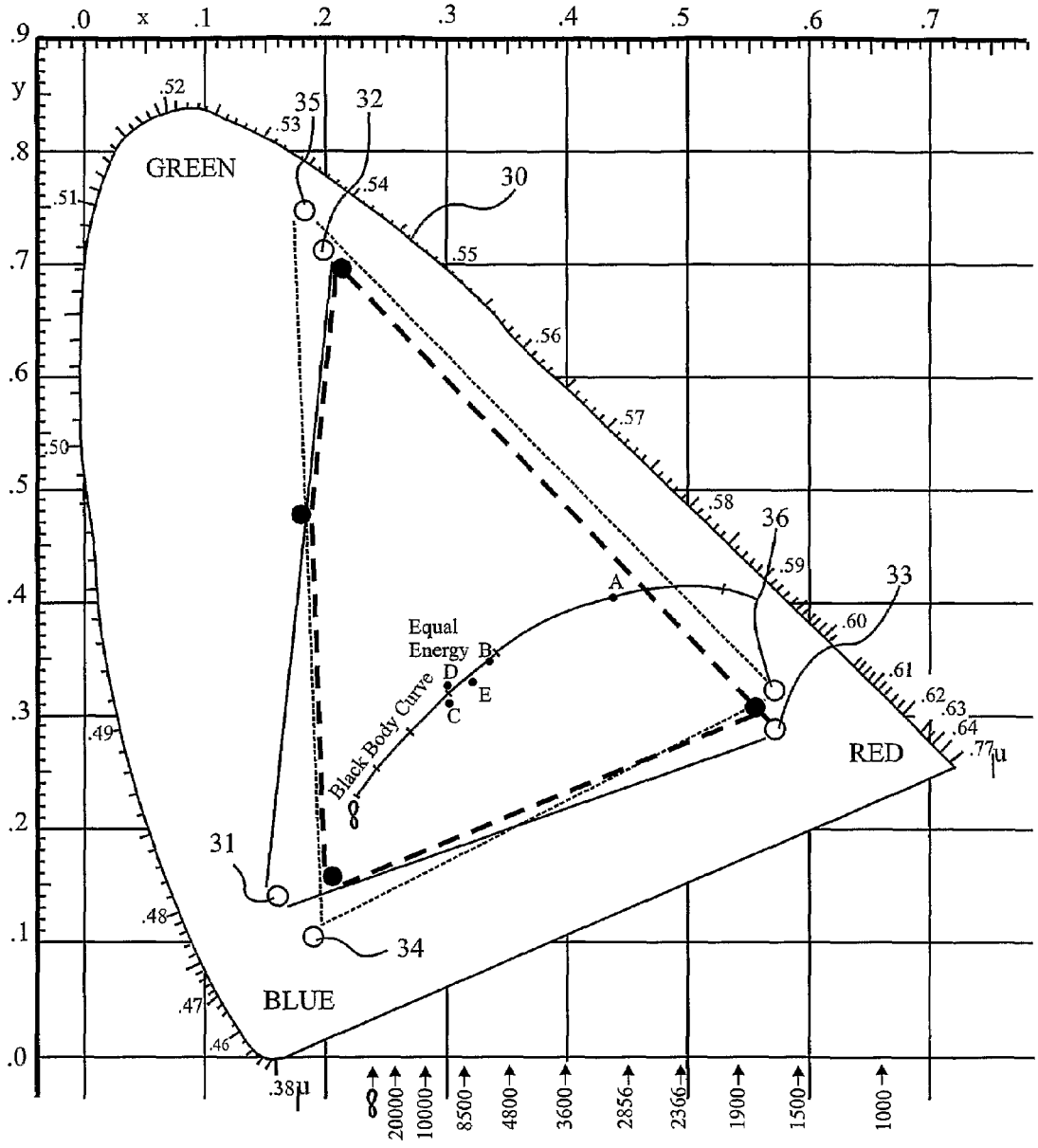
FIG. 3 illustrates a colour space.

FIG. 3 illustrates a CIE chromaticity colour space as known by those skilled in the art. Such colour space diagrams are well known. Effectively it has been found that any colour which may be observed by a human eye can be expressed in terms of the two X and Y co-ordinates. The gamut of observable colours is determined by the shaded area defined by circumference 30. The colours which can be made by a combination of a particular set of three primary coloured LEDs are given by triangles within this circumference. If an LED array contains red, green and blue LEDs the triangle which defines the gamut of possible colours produceable by a combination of those LEDs is defined by the characteristics of the coloured LEDs in a particular lighting fixture. For this reason because each LED array will contain LEDs having slightly different characteristics (as determined to a certain extent by their BIN allocation) the triangles for each LED array will be different. It will also be understood that embodiments of the present invention can be used with arrays of LEDs having more than three colours. The gamut can be expanded by adding a fourth or further colours e.g. amber.

FIG. 3 illustrates two such triangles which define two respective gamuts of possible colours for two respective LED arrays. The first is defined by points 31, 32 and 33 whilst the second triangle is defined by points 34, 35 and 36. It will be noted that the triangle defined by points 31, 32 and 33 which define a possible range of colours which may be produced by a respective LED array are able to generate colours which may not be produced by the LED array associated with points 34, 35 and 36. These are the colours where the two triangles do not overlap. However there is a common region, which is not triangular, which corresponds to the areas of the colour space where both triangles do overlap. Any colour from within this region which corresponds to an overall gamut of possible colours may be generated by both LED arrays. Thus if a colour from within this region is selected the two lighting fixtures within which the two LED arrays are mounted can produce an identical colour. As noted above the reason why LED arrays containing similar numbers and arrangements of red, green and blue LEDs cannot generate identical overall colours is because of manufacturing differences when manufacturing the red, green and blue LEDs. As a result of such manufacturing differences, whilst a red LED may be manufactured to generate light at a fixed wavelength, for example 633 nanometers, the LED may in fact, when made, illuminate at a higher or lower wavelength. It is for this reason that LEDs are batched into ranges of characteristics and allocated BIN numbers. Effectively when producing LEDs a certain degree of production variance exists. Hence if one considers green LEDs the variance is from deep to light green. The full production spread is split into BINs to enable manufactures further downstream using LEDs to perhaps select out LEDs which don't meet an application specification. This is often the case in signalling applications where some of the production spread may be outside of an agreed specification.

A BIN is a defined area which can be given as coordinates on the 1931 CIE chart, the coordinates usually comprise a set of 4 x, y limits which define a box. Thus LEDs produced and labelled within a certain BIN will lie within the 4 coordinates. A CIE u, v chart is another chart which can be used to describe a BIN.

A second part of a BIN code may be included which relates to intensity which again may vary with production spread. Hence the part of the bin code relating to intensity defines the performance of the LED between a minimum and maximum value. A possible way of overcoming a problem of multiple lighting fixtures which are required to generate similar lighting colours and intensities would therefore be to carefully select LEDs in respective LED arrays matching the LEDs as closely as possible. However this would be a particularly onerous task and would not be possible on a large scale.

The present invention overcomes this problem by noting the characteristics of LEDs mounted on the LED arrays and using this information when generating drive signals to the LEDs. By storing the BIN number of an LED it may be predetermined how that LED will act when supplied with drive signals. For the red LEDs for each specific LED array it will therefore be able to select the apex point of the triangle. Likewise for the green LEDs in a respective LED array the apex point corresponding to points 32 or 35 may be selected. Also a similar point may be calculated for the blue LEDs of an LED array. Subsequent to this the gamut of colours produceable by that LED array may be established by determining the triangle of possible colours defined by those three calculated points.

If more than one lighting fixture (and thus more than one LED array) is being used in a lighting system then the possible gamut of colours may be established for all lighting fixtures in that lighting system and only colours falling within an area of the colour space which may be commonly produced by all lighting fixtures will be selected. Once such a colour has been selected drive signals are produced by power circuitry 16 for each lighting fixture to generate that colour.

Figure 4:
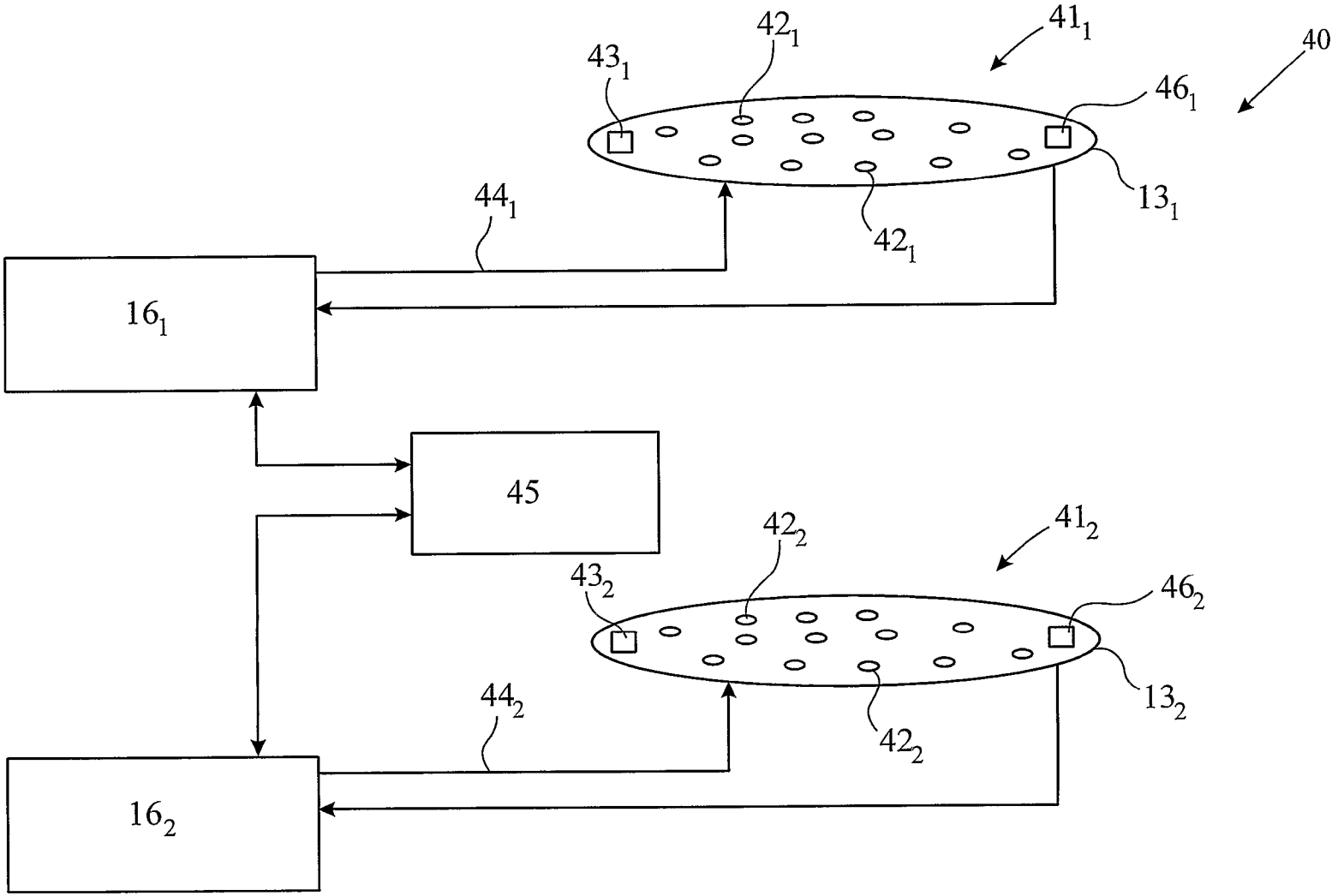
FIG. 4 illustrates plural LED arrays arranged in a lighting system.

FIG. 4 illustrates a lighting system 40 which includes two LED arrays 41 each of which includes a matrix of LEDs 42 mounted on a respective PCB 13. When the LED array 41 is manufactured the BIN numbers (or indeed any other identifier which can identify a relevant characteristic of an LED) of each LED in the array is determined and stored on storage device 43 such as an EEPROM. It will be understood that it is not necessary but merely advantageous to store information relating to each LED. Any alternative method of storing this information may be used for example via a set of settable switches or via solder bridges which may be made. As a result when an LED array is manufactured characteristics of one or more or preferably all LEDs on an LED array are known and stored on that LED array. When a subsequent manufacturer comes to build a lighting fixture or indeed a lighting system comprising more than one lighting fixture the information stored on the LED array may be used when generating illumination from that LED array. It will be understood that rather than storing the BIN numbers for an LED some other parameter indicating characteristics of the LED (such as x, y or u, v values) may be stored.

During operation of the lighting system 40 drive signals are provided to the LED array via connection 44 from driver circuitry 16 as noted above. These drive signals which are used to turn on the LEDs in the LED array as illustrated better in FIG. 2 are determined having regard to the information stored in the storage member 43. This information is first downloaded either automatically or manually into the power circuitry 16 or as an alternative to an overall control unit 45. It is then stored at that point. It is preferable that the information for each LED array is only stored in the power circuitry associated with that LED array. The overall control unit 45 then uses information accessed from each power drive circuitry 16 to select one or more colours to be generated from the overall possible gamut of colours which is within the range of colours which may be generated by all of the lighting fixtures in the lighting system.

Once a desired observed colour is selected the overall signal control unit 45 which is preferably a DMX signal generator provides identical signals to power driver circuitry 16. Table 1 below indicates the values (0-255) produced on each of the red, green and blue channels during DMX signalling and the colours that these signals may be expected to produce:

TABLE 1

| Colour name | Red | Green | Blue |
|---|---|---|---|
| Red | 191 | 27 | 75 |
| Pink | 245 | 220 | 208 |
| Reddish orange | 216 | 119 | 51 |
| Orange pink | 240 | 204 | 162 |
| Orange | 228 | 184 | 29 |
| Yellowish orange | 231 | 224 | 0 |
| Yellow | 234 | 231 | 94 |
| Greenish yellow | 235 | 233 | 0 |
| Yellow green | 185 | 214 | 4 |
| Yellowish green | 170 | 209 | 60 |
| Green | 0 | 163 | 71 |
| Bluish green | 24 | 162 | 121 |
| Blue green | 95 | 164 | 190 |
| Greenish blue | 110 | 175 | 199 |
| Blue | 92 | 138 | 202 |
| Purplish blue | 88 | 121 | 191 |
| Bluish purple | 92 | 102 | 177 |
| Purple | 246 | 85 | 158 |
| Reddish purple | 196 | 64 | 143 |
| Purplish pink | 243 | 208 | 219 |
| Red purple | 175 | 35 | 132 |
| Purplish red | 209 | 65 | 136 |
| White | 255 | 255 | 255 |

Each power control circuitry uses the input control signals to generate pulse wave modulation signals (or linear FWM or BAM signals as noted above) to drive the respective LEDs in the LED array associated with power control circuitry. However the information stored in the storage member 43 which is accessible or stored in the power control circuit may be used to modify the expected values. For example if the green LEDs on a LED array 411 are known to be of a bluish green BIN number then the pulse wave modulation signals generated in the power control circuitry may be adjusted so as to reduce the effects of the blue LEDs or make some other compensating modification so that the desired colour and intensity is produced.

Each LED array as illustrated in FIG. 4 is also provided with a temperature sensor 46. This provides a temperature indication of the PCB 13 to the control circuitry 60 either continually or periodically. By measuring the temperature of the PCB an estimate of the temperature at the LEDs in the LED matrix may be calculated. The temperature sensor is provided because as temperature fluctuates the response by different LEDs will be non-uniform. This is particularly noticeable with red LEDs whereby due to their manufacturing details their response to temperature fluctuation is exponential. By contrast the performance of green and blue LEDs tends to be linear with changes in temperature. The result is that for a unit change in temperature the colour and intensity of the red LEDs will change substantially relative to change in blue and green LEDs. As a result an overall colour generated by the whole LED array may change from a desired value. Information relating to the respective LEDs on the LED array will be stored on the storage device 43 and that information will be provided to the power circuitry as noted above. Thus as the temperature varies, by either increasing or decreasing, the drive signals to the respective LEDs may be varied so that the overall performance of the LED array falls within desired limits.

Embodiments of the present invention have been described herein above by way of example only. It will be understood that modifications may be made to the specifically described examples without departing from the scope of the present invention.

In particular it will be noted that whilst the LED arrays have been described as including a temperature sensor this feature and its respective results may be used independently of the selection process by which a colour which is commonly generatable by all lighting fixtures in a multi-lighting fixture lighting system may be made.

Also although embodiments of the present invention have been described with respect to arrays of red, green and blue LEDs applications of the present invention may be made with respect to arrays of LEDs of any colour or combination of colours.

The invention claimed is:

1. A method for providing illumination from at least one Light Emitting Diode (LED) lighting fixture each of which comprises a respective LED array, comprising the steps of:

determining at least one parameter of one or more LEDs associated with an LED array;

for each lighting fixture, based upon said parameter, determining a gamut of possible colours which can be generated by a plurality of LEDs arranged in the respective LED array of that lighting fixture; and supplying drive signals to light LEDs in said LED array responsive to said parameter;

thereby providing illumination having a desired characteristic from said lighting fixture.

2. The method as claimed in claim 1 further comprising steps of:

determining an overall gamut of possible colours which can be commonly generated by all of the LED arrays of each of said at least one lighting fixture.

3. The method as claimed in claim 2 further comprising the steps of:

providing drive signals to, LED arrays in each of the at least one lighting fixture to generate illumination having a colour selected from said overall gamut.

4. The method as claimed claim 1 further comprising the steps of:

storing information identifying a characteristic of one or more LEDs in an LED array for each lighting fixture and subsequently determining the gamut of possible colours responsive to the stored information.

5. The method as claimed in claim 4 further comprising the steps of:

storing a BIN code for each LED in said LED array.

6. The method as claimed in claim 4 further comprising the steps of:

storing an x, y and/or u, v value for each LED in said LED array.

7. The method as claimed in claim 5 further comprising storing said BIN code via an EEPROM located on a programmable circuit board (PCB) on which said LED array is mounted.

8. The method as claimed in claim 5 further comprising storing said BIN code via a set of switches located on a programmable circuit board (PCB) on which said LED array is mounted.

9. The method as claimed in claim 5 further comprising storing said BIN code via solder bridges located on a programmable circuit board (PCB) on which said LED array is mounted.

10. The method as claimed in claim 1 further comprising steps of:

determining a temperature of an LED array in one or more of said LED lighting fixtures.

11. The method as claimed in claim 10 further comprising the steps of:

varying the drive signals to one or more LEDs in said LED array responsive to said determined temperature.

12. Apparatus for providing illumination from at least one Light Emitting Diode (LED) lighting fixture, comprising:

at least one LED array, each being associated with a respective lighting fixture;

means for determining at least one parameter of one or more LEDs associated within an LED array and, for each fixture, for determining a gamut of possible colours which can be generated by a plurality of LEDs, arranged in the respective LED array of that lighting fixture based upon said parameter; and power driver circuitry adapted to supply drive signals to selectively light LEDs in the LED array responsive to the determined parameter;

wherein the LEDs are lit so as to provide illumination having a desired characteristic.

13. Apparatus as claimed in claim 12 wherein said means for determining determines said at least one parameter for an LED array in each lighting fixture.

14. Apparatus as claimed in claim 12 wherein the means for determining is arranged to determine an overall gamut of possible colours which can be commonly generated by all of the LED arrays of each of said at least one lighting fixture.

15. Apparatus as claimed in claim 12 wherein the at least one parameter comprises a temperature of an LED array.

16. A lighting fixture for providing illumination comprising:

an LED array comprising red, green and blue LEDs arranged in a matrix; and means for storing information identifying a parameter associated with each LED in said LED array, said information being readable to determine a gamut of possible colours which can be generated by the LED array and to enable power driver signals used to light said LEDs to be selected so as to provide illumination from said LED array having a desired characteristic.

17. The lighting fixture as claimed in claim 16 further comprising:

means for measuring a temperature of a PCB to which said LED array is mounted and for providing a signal indicating said measured temperature to power driver circuitry used to supply power driver signals to said LEDs.

18. The lighting fixture as claimed in claim 16 further comprising:

power driver circuitry for supplying power driver signals to said array of LEDs.

* * * * *